United States Patent [19]

Kirby

[11] 4,111,137

[45] Sep. 5, 1978

[54] CUFF MAKING MACHINE

[75] Inventor: Robert Willis Kirby, Kinston, N.C.

[73] Assignee: Hampton Industries, Inc., Kinston, N.C.

[21] Appl. No.: 728,700

[22] Filed: Oct. 1, 1976

[51] Int. Cl.[2] ..... D05B 21/00; D05B 33/00

[52] U.S. Cl. ..... 112/121.15; 112/121.29; 112/287

[58] Field of Search ..... 112/121.15, 121.12, 112/121.11, 121.29, 102, 252, 203; 198/33 R, 33 AC

[56] References Cited

U.S. PATENT DOCUMENTS

| | | | |
|---|---|---|---|
| 3,097,733 | 7/1963 | Frydryk | 112/121.15 X |
| 3,170,423 | 2/1965 | Henebry | 112/121.12 |
| 3,680,508 | 8/1972 | Baig et al. | 112/121.12 |
| 3,696,765 | 10/1972 | Bernewasser | 112/121.12 |
| 3,754,520 | 8/1973 | Bennison | 112/121.12 |
| 3,901,172 | 8/1975 | Junkins | 112/121.12 |
| 3,970,016 | 7/1976 | Yanikoski | 112/121.12 |
| 3,980,033 | 9/1976 | Frost et al. | 112/121.15 X |

*Primary Examiner*—H. Hampton Hunter
*Attorney, Agent, or Firm*—Seidel, Gonda & Goldhammer

[57] ABSTRACT

An apparatus for stitching a pair of parallel spaced seams on a workpiece, such as a cuff, is disclosed. A rotatable workpiece clamp is provided for holding the workpiece. The clamp is reciprocated between a forward and a rearward position. A means for stitching a seam, such as a sewing machine, is provided. The stitching means sews along an edge of the workpiece while the clamp is moving in one of the forward and rearward directions. A means is also provided for rotating the clamp after a seam has been stitched along an edge of the workpiece.

24 Claims, 5 Drawing Figures

CUFF MAKING MACHINE

BACKGROUND OF THE INVENTION

The invention relates to a machine for sewing together pieces of fabric to form cuffs for shirts. One method of forming a cuff is to fold a single piece of fabric along its lengthwise direction and to stitch two parallel seams along its width. The lengthwise fold and the two widthwise seams thereby secure three sides of the cuff. If desired, a lining material may be placed over the folded fabric and also stitched along the widthwise dimension. A cuff sewn in the above-described manner is in an inside-out relationship with respect to its final disposition on a shirt. Such a cuff is therefore turned inside-out before being sewn to a shirt.

Various methods for sewing the seams of a cuff have been employed. One method was to manually feed the fabric to a sewing machine for stitching the first seam and then manually reposition the fabric for stitching the second seam along the opposite edge of the fabric. Other methods utilized a plurality of sewing machines.

One type of prior art device uses a sewing machine which translates with respect to the fabric. Another type of prior art device utilizes a jig whose shape determines the path through which the fabric will be driven during the sewing cycle, while another type of prior art device utilizes a tape to control the motion of the fabric during the sewing cycle.

Prior art devices of the general type involved herein are disclosed in U.S. Pat. Nos. 3,097,733; 3,428,005; 3,762,348; 3,769,924; and 3,889,613.

SUMMARY OF THE INVENTION

The invention relates to an apparatus for stitching spaced seams on a workpiece such as the cuff of a shirt. The apparatus is provided with a rotatable workpiece clamp for holding a workpiece and a means for reciprocating the clamp between a forward and a rearward position. A means is provided for stitching a seam along an edge of the workpiece while the means for reciprocating the clamp is moving the clamp in one of the forward and rearward directions. A means is also provided for rotating the clamp after a seam has been stitched along an edge of the workpiece.

In the preferred embodiment, an operator places the workpiece to be stitched into an open workpiece clamp. The operator thereafter closes the clamp and initiates the automatic sewing cycle. The clamp thereafter moves from its forward position to its rearward position and while moving passes an edge of the workpiece through the sewing mechanism. A seam is thereby stitched along a first edge of the workpiece. Upon reaching the rearward position, the clamp is automatically rotated 90°. After the 90° rotation of the clamp, the clamp automatically begins its movement back to its forward position. Before reaching its forward position, the clamp is again automatically rotated another 90° in the same angular direction. Upon reaching the forward position, the clamp is again moved to its rearward position with the workpiece passing through the sewing mechanism. Since the workpiece has been rotated 180° from its initial position, a seam will thereby be stitched along a second edge when the workpiece passes through the sewing mechanism. After the second seam has been stitched to the workpiece and the clamp reaches its rearward position, the stitched workpiece is automatically removed from the clamp and placed in a stacking mechanism with other stitched workpieces.

It is an object of the invention to provide a device for stitching a pair of parallel spaced seams on a workpiece in a simplified and rapid manner.

Another object of the invention is to provide a clamp for a workpiece to be stitched which both translates in a horizontal plane between a forward and a rearward position and also rotates about an axis perpendicular to the plane of translation.

It is another object of the invention to provide a device, which after the insertion of the workpiece to be stitched and the closing of the workpiece clamp, automatically stitches a pair of parallel spaced seams on the workpiece.

Other objects will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
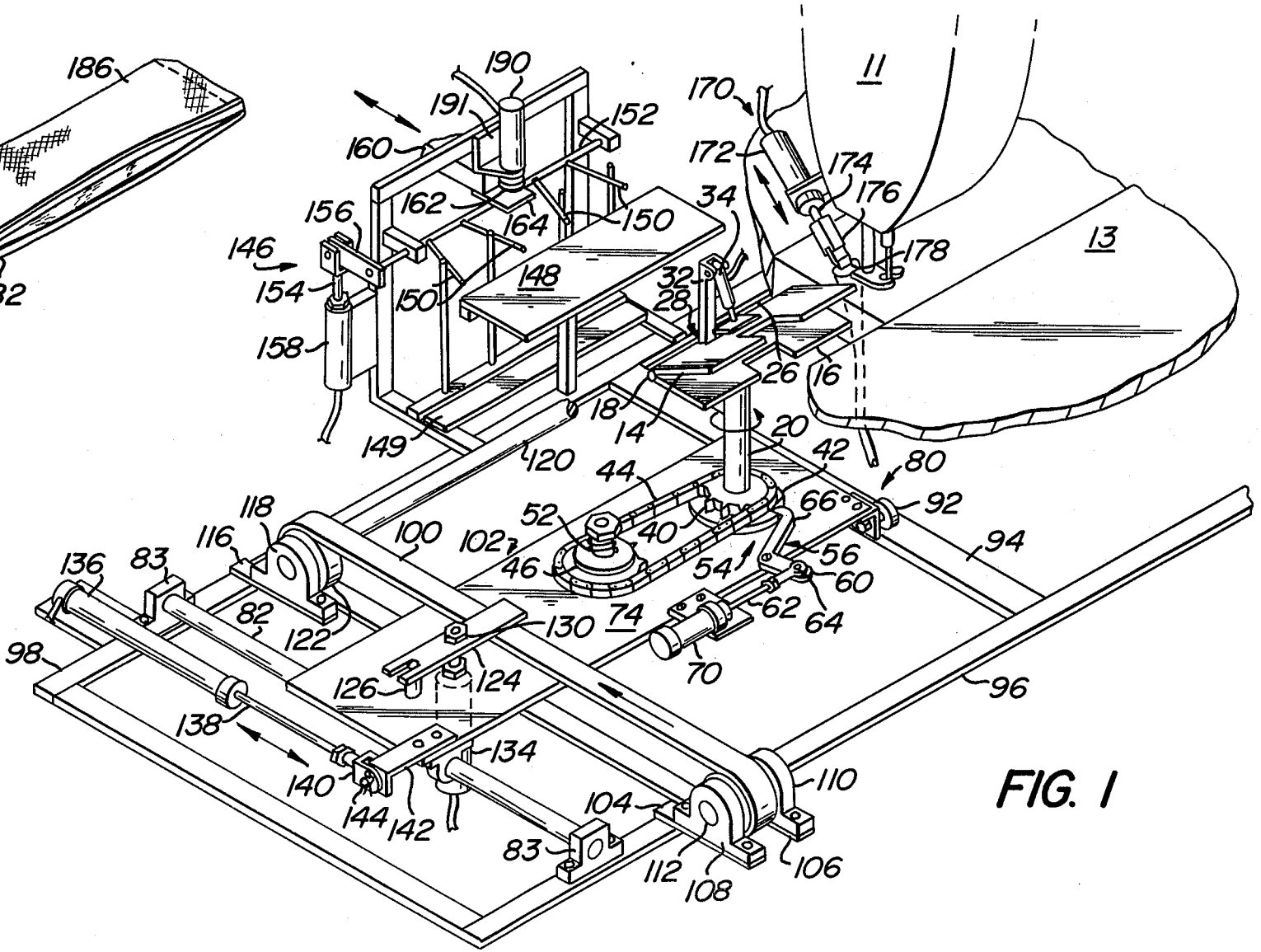
FIG. 1 is a perspective view of the apparatus in accordance with the present invention.

Referring to the drawings in detail, wherein like numerals indicate like elements, there is shown in FIG. 1 a perspective view of the apparatus of the present invention designated generally as 10. A sewing machine 11 for stitching seams to the workpiece being processed by the apparatus of the present invention is stationary and is supported on surface 13. A rotatable clamp 12 holds the workpieces to be stitched by the sewing machine 11. The rotatable clamp 12 is comprised of a stationary bottom plate 16 and a movable top plate 14. The top plate 14 is pivotable with respect to the bottom plate 16 about a hinge 18. The bottom plate 16 is fixedly secured to a shaft 20 which is freely rotatable about a vertical axis. The shaft 20 has a longitudinal bore 22 extending completely therethrough.

The hinge 18 is comprised of two separate sections 24, 26. The sections 24, 26 are separated by a gap 28 located in the central area of the rotatable clamp 12. The top plate 14 has an open area 30 located adjacent to the gap 28.

An upright bar 32 is secured to the bottom plate 16. The upright bar 32 extends vertically above the top plate 14 through the open area 30. The upright bar 32 supports an air cylinder 34. The air cylinder 34 has a slideable piston rod 36 extending therefrom.

The air cylinder 34 is a spring biased type of air cylinder. In a spring biased air cylinder, the piston rod carried by the cylinder is spring biased in one direction and the admission of pressurized air into the cylinder will move the piston rod in the direction opposite its bias. When the air is cut off from the cylinder, the spring will return the piston rod to its biased position. The piston rod 36 is biased to a retracted position within cylinder 34.

The piston rod 36 is secured to the top plate 14 and will move the top plate 14 between its open and closed positions. The piston rod 36 in its biased position holds the top plate 14 open. Air to move the piston rod 36 downwardly is supplied to the air cylinder 34 from a source 200 (shown diagrammatically in FIG. 5). The air is supplied from the source 200 to the bore 22 within the shaft 20 and thereafter through the tubing 38 to the top of the cylinder 34.

A sprocket 40 is fixedly secured to the shaft 20 near its lower end. An indexing cam 42 is also fixedly secured to the shaft 20 at a level below that of the sprocket 40. A chain 44 engages the sprocket 40 and a gear wheel 46. The gear wheel 46 is connected through a slip clutch mechanism 52 to a drive shaft 48 of a motor 50. Motor 50 is an A.C. motor, which is constantly driven during the operation of the apparatus.

An indexing pawl 54 engages stops 55 on the indexing cam 42. The indexing pawl 54 is comprised of a right angled member 56 rotatable about the axis of a support shaft 58. The right angled member 56 has one arm 60 secured to a piston rod 62 by way of a pin 64. The other arm 66 has a latch portion 68 adapted to engage the stops 55. While the extended portion 68 engages a stop 55, the sprocket 40 cannot rotate.

The piston rod 62 is slideably received within an air cylinder 70. The air cylinder 70 is also a spring biased type. The piston rod 62 is biased to its extended position, which engages the latch 68 to a stop 55. Pressurized air is intermittently supplied in short pulses to air cylinder 70 and causes the piston rod 62 to retract. This retraction of rod 62 causes the latch 68 to disengage from a stop 55. This disengagement of the latch 68 from a stop 55 allows the chain 44 to drive the sprocket 40 and the shaft 20 in the direction of arrow 72. The disengagement of latch 68 from a stop 55 is only momentary because only a short pulse of air is supplied to the cylinder 70 and the spring bias immediately returns the piston rod 62 to its extended position after the pulse ends. The latch 68 will therefore abut the next stop 55 in the direction of rotation of the index cam 42. The index cam 42 has four stops 55 spaced at 90° intervals. The shaft 20 and the rotatable clamp 12 are thereby rotated in 90° increments.

The rotatable clamp 12, the shaft 20, the indexing pawl 54, the motor 50 and the air cylinder 70 are all carried by a support plate 74. The support plate 74 is free to translate in the directions of arrows 76 and 78. The plate 74 is supported on one side by a roller means 80 engaging a rail 94 and by a cylindrical rod 82 on its other side. The roller means 80 is comprised of an angle iron 84 having one arm 86 secured to the support plate 74 and its other arm 88 carrying an axle 90. The axle 90 carries a rotatable wheel 92 which rides on rail 94. Bearings 81, 83 are secured to the bottom face of support plate 74. The bearings 81, 83 are aligned to slideably receive the cylindrical rod 82. The cylindrical rod 82 and the rail 94 are supported by base rails 96, 98.

Figure 3:
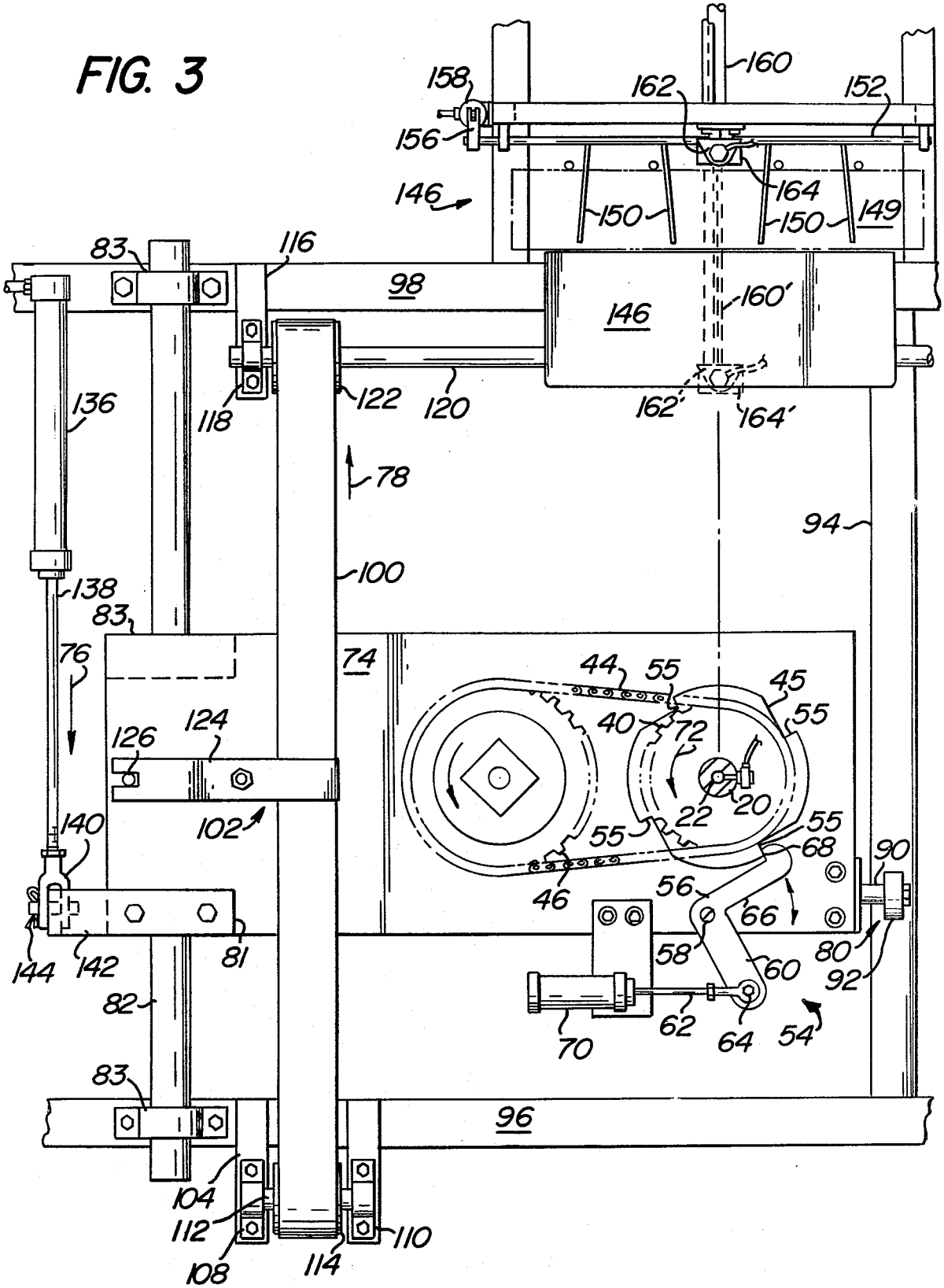
FIG. 3 is a view taken along lines 3—3 of FIG. 2.

The entire support plate 74 is thus supported by the cylindrical rod 82 and the rail 94. The support plate 74 is free to translate between a forward position designated as A in FIG. 3, and a rearward position, designated as B in FIG. 3. Separate drive means are provided for moving the support plate 74 from a forward to rearward position and from a rearward to a forward position.

The means to drive the support plate from the forward to the rearward position comprises a driven endless belt 100 and a clamping means 102 carried on the support plate 74. A pair of support brackets 104, 106 are supported by the base rail 96. The brackets 104, 106 carry bearings 108, 110 which in turn support a rotatable shaft 112. A pulley 114 is fixedly secured to the shaft 112 and carries about it the endless belt 100. The base rail 98 carries a similar support bracket 116. The support bracket 116 carries a bearing 118 which has a driven shaft 120 journaled therein. The driven shaft 120 is connected to a motor through a clutch (not shown).

The clutch is activated by a spring biased air cylinder similar to cylinders 34, 70. The piston rod of the air cylinder, which controls the clutch, is biased to disengage the clutch from the shaft 120. Thus, when air is supplied to the cylinder, the clutch will engage the shaft 120.

A pulley 122 is fixedly secured to the driven shaft 120 and carries about it the endless belt 100. The endless belt 100 is thereby looped around pulleys 114, 122 and is driven by means of the shaft 120. The top portion of endless belt 100 passes above the support plate 74, while the bottom portion of endless belt 100 passes below the support plate 74. When driven shaft 120 is rotated, the top portion of endless belt 100 is moved in the direction of arrow 78.

The clamping mechanism 102 comprises a clamping bar 124 carried by a pair of shafts 126, 128. The clamping bar 124 is biased upwardly against a lock nut 130 by a spring 132, which surrounds shaft 138. The shaft 128 forms a portion of a piston rod carried by an air cylinder 134. The air cylinder 134 is also a spring biased type which bias the shaft 138 in the same direction as spring 132. By activating air cylinder 134, the shaft 128 can be drawn downwardly against the bias of spring 132 and the bias of cylinder 134. When the clamping bar 124 is pulled downwardly, it presses the upper portion of endless belt 100 against the top major face of support plate 74. In this manner, the top portion of endless belt 100 and the support plate 74 become fixed relative to one other. The entire support plate 74 is thereby driven in the direction of arrow 78 by the motion of belt 100. As will be more fully explained herein, the air cylinder 134 is activated when the support plate 74 is at the forward position A and is deactivated when the support plate 74 reaches the rearward position B.

An air cylinder 136 is also secured to base rail 98 and has a piston rod 138 slideably extending therefrom. The piston rod 138 carries a yoke 140 at its free end. The yoke 140 is secured to an angled bracket 142 by way of a pin 144. The angled bracket 142 is fixedly secured to the top surface of support plate 74. The air cylinder 136 and piston rod 138 provide the means for moving the support plate 74 from its rearward position B to its forward position A. As will be more fully explained herein, pressurized air is supplied to cylinder 136 at proper times in the sewing process to thereby drive piston rod 138 and support plate 74 in the direction of arrow 76.

A stacking mechanism 146 is provided for removing the sewn workpieces from the clamp 12. The stacking mechanism 146 includes a horizontal plate 148 which abuts the bottom plate 16 when the support plate 74 is in the rearward position B. Located rearwardly of the horizontal plate 148 is a stacking base 149 for stacking the stitched workpieces.

Figure 5:
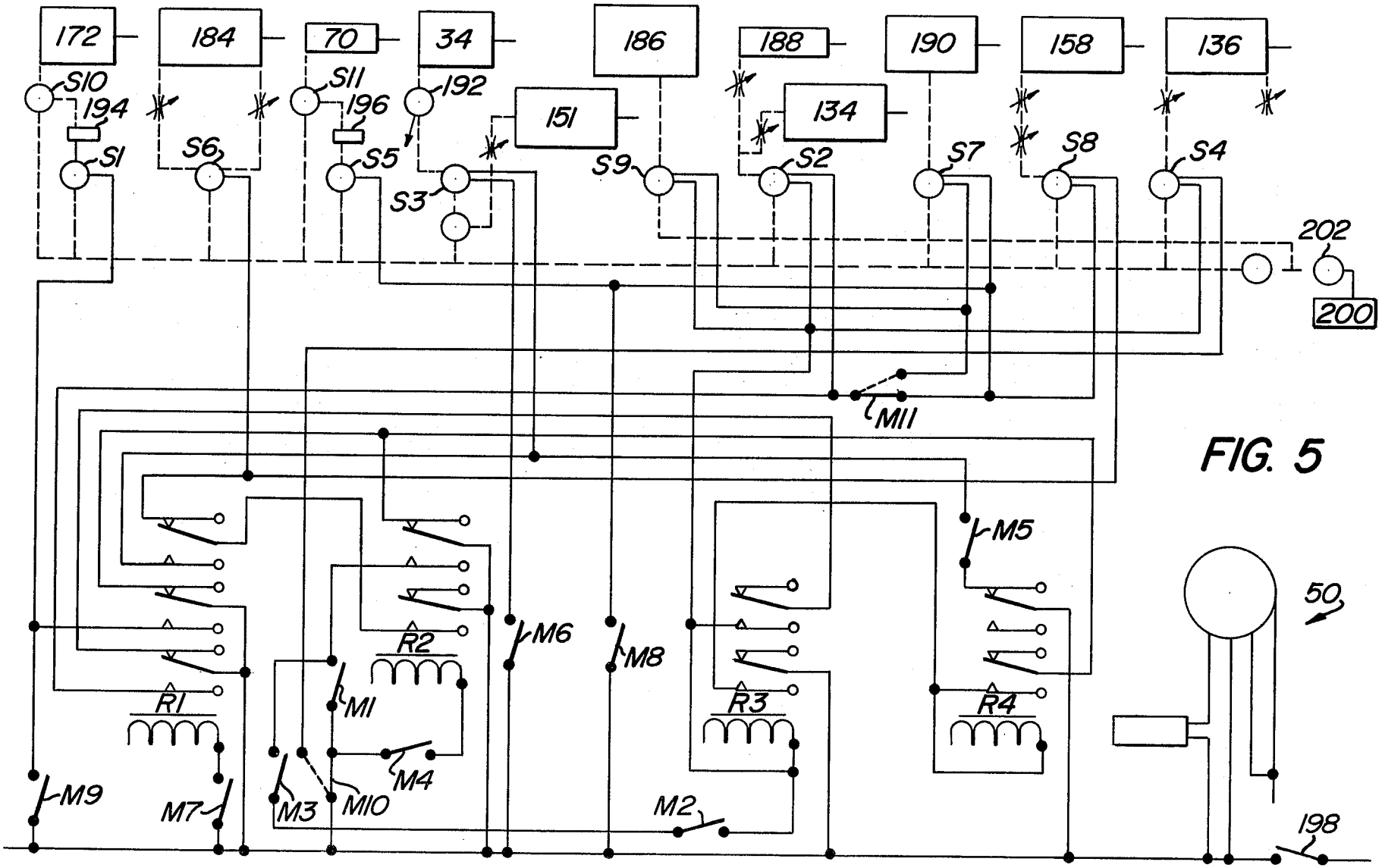
FIG. 5 is a schematic drawing of the pneumatic and electronic controls for the invention.

A stacking base 149 is carried by a piston rod of air cylinder 151 (see FIG. 5). As more stitched workpieces are stacked on base 149, the piston rod of cylinder 151 retracts against the pressure of the air supplied to the cylinder 151.

The stitched workpieces are held in place on the base 149 by a plurality of fingers 150. The fingers 150 are fixedly secured to a rod 152. The fingers 150 may be pivoted upwardly and downwardly of the rotation of rod 152. The fingers 150 are moved upwardly to admit workpieces onto the stack and moved downwardly to secure the workpieces in the stack. The rod 152 is rotated by moving piston rod 154 upwardly or downwardly. The free end of the piston rod 154 is connected to a yoke 156. The motion of the piston rod 154 rotates the yoke 156. The yoke 156 is fixedly secured to the rod 152, so that its rotation also rotates rod 152. The piston rod 154 is slideably received within a spring biased air cylinder 158, which biases the rod 152 to a retracted position. As will be more fully explained herein, air is supplied to cylinder 158 at proper intervals to move the piston rod 154.

The stitched workpieces are removed from the workpiece clamp 12 by a stacker arm 160 having stacker jaws 162, 164 secured to its free end. The stacker arm 160 and stacker jaws 162, 164 are shown in their retracted positions in solid lines in FIG. 3 and also in their extended positions in dashed lines in FIG. 3. In their extended positions, the stacker arm 160 and the stacker jaws 162, 164 are indicated by primed numerals. The stacker arm 160 is driven by a conventional air cylinder 184 and piston rod (not shown). The movable stacker jaw 162 is also moved by a spring biased air cylinder 190 having a piston rod 191 biased to a retracted position. When a stitched workpiece is to be placed in the stacking area, the stacker arm 160 moves to its extended position and the fingers 150 and the stacker jaw 162 move upwardly. When the stacker 160 is fully extended and the workpiece clamp 12 is in its rearward position B, an edge of the workpiece will be received between the stacker jaws 162, 164. The piston rod 191 will move the stacker jaw downwardly and thereby clamp the edge of the workpiece between the jaws 162, 164. The stacker arm 160 will thereafter move rearwardly and deposit the stitched workpiece in the area 149, beneath the fingers 150.

As seen in FIG. 1, a thread cutting mechanism 170 is provided adjacent the sewing machine 11. The cutting mechanism 170 comprises a spring biased air cylinder 172 having a piston rod 174 biased to a retracted position. A cutting blade 176 is attached to the free end of piston rod 174. A pulse of air to air cylinder 172 moves piston rod 174. The cutting blade 176 will thereby cut any excess thread. Since only a pulse of air is supplied to the cylinder 172, the rod 174 returns to its retracted position after the pulse ends. The excess thread is withdrawn through port 178 by means of a slight vacuum applied to the port.

Figure 4:
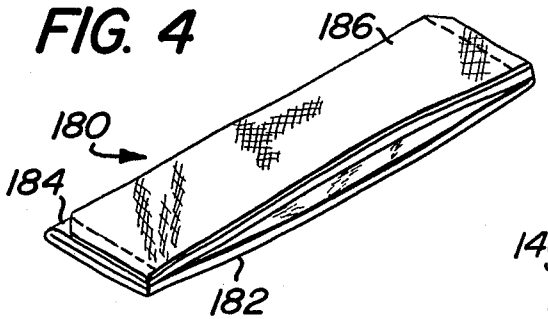
FIG. 4 is a perspective view of a typical cuff which can be stitched by the present invention.
Figure 2:
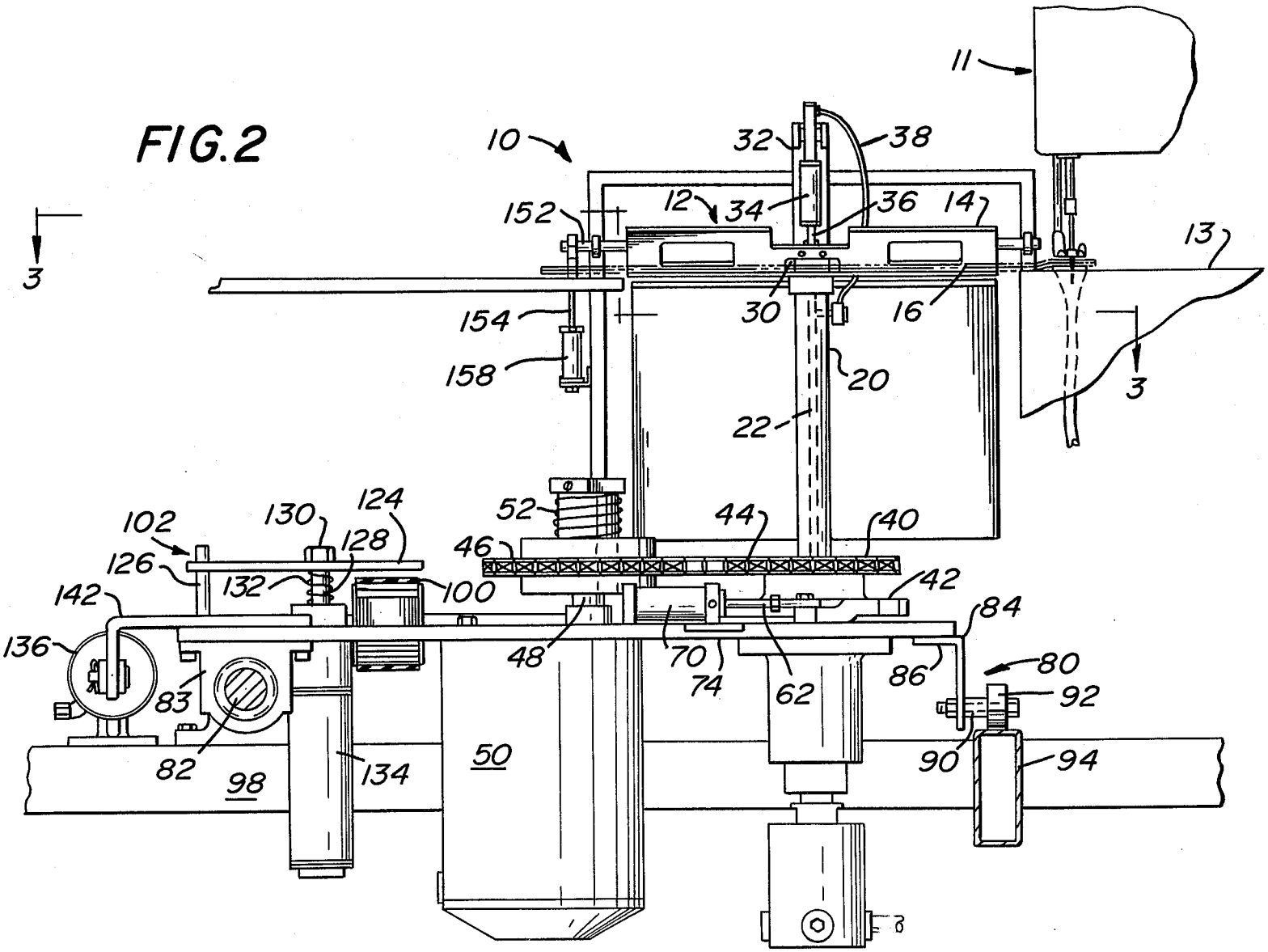
FIG. 2 is an elevational view of the invention.

A typical workpiece, such as a cuff 180, which can be sewn by the present invention is shown in FIG. 4. The fabric 182 is folded along line 184 and a piece of lining material 186 is placed on top of the fabric. The fabric 182 and the lining 186 can thereafter be placed within the clamp 12 and the process of sewing begun.

With reference to FIG. 5, the operation of the present invention will be explained. In the following description, the numerals referring to air valves will be preceded by the letter "S". The numerals indicating electrical relays will be preceded by the letter "R" and the numerals indicating microswitches will be preceded by the letter "M". All of the relays "R" are shown in their open position. The drive motor 50 and a main power switch 198 connected to a source of A.C. power are shown in FIG. 5. A source of pressurized air 200 as well as inlet regulator filter 202 are also shown in FIG. 5.

A plurality of solenoid operated air valves are shown in FIG. 5 and will be discussed hereinafter. The solenoid operated air valves having one electrical connection are single action valves. The presence of current at the connection will activate and open the valve, while the lack of current at the connection will deactivate and close the valve. The solenoid operated air valves having two electrical connections are double acting valves. Current to one of the connections will open the valve and current to the other connection is required to close the valve.

An operator will place a workpiece, such as cuff 180, between top plate 14 and bottom plate 16. The operator will thereafter depress a foot pedal which will engage microswitch M6. Microswitch M6 will activate a solenoid operated air valve S3. The activated valve S3 allows air to enter cylinder 34 to thereby close the clamp 12. With the cuff in position and the clamp closed, the apparatus is ready to begin its automatic operation if the following conditions are met. The microswitch M10 must be closed. The microswitch M10 will be closed when the clamp 12 is in its proper rotational position for beginning the sewing operation. The clamp 12 is in its proper rotational position when the lengthwise dimension of the clamp 12 is parallel with rail 96. Microswitch M2 must also be closed. Microswitch M2 is closed when the support plate 74 is in its most forward position A. Microswitch M3 must also be closed. M3 is an air operated microswitch which indicates that the clamp 12 is closed. Microswitch M3 is operated by the same air which operates air cylinder 34. A portion of this air is diverted to microswitch M3 by a diverter 192. Microswitch M1 must also be closed. Microswitch M1 is a foot operated starting switch.

When the above conditions are met and the microswitch M1 is activated, current is supplied to a solenoid operated air valve S2 by way of relay R3. When the valve S2 is activated, it supplies air to cylinder 134 which pulls down shaft 128 and the clamping bar 124. The air supplied through the valve S2 also activates a motor clutch cylinder 188 which places shaft 120 into driving engagement with its motor. The clamping bar 124 firmly secures the endless belt 100 to the support plate 74 and the rotating shaft 120 drives the endless belt 100 and the support plate 74 rearwardly in the direction of arrow 78.

At the initiation of the sewing process, relay R3 is pulled in. Relay R3 in turn pulls in relay R4. With relay R4 pulled in, the circuit going to microswitch M5 is broken. Current from microswitch M5 will signal the valve S3 to close and to thereby open clamp 12. The microswitch M5 can be operated by a manual foot pedal. However, with relay R4 pulled in, no current will be supplied to microswitch M5 even if its associated foot pedal is depressed. An accidental opening of the clamp 12 is thereby prevented during the sewing cycle. As will be seen later, relay R4 drops out near the end of the sewing cycle in order to open the clamp 12.

The sewing machine is now running and the support plate 74 and clamp 12 is moving from forward position A to the rearward position B. After the support plate 74 moves approximately ½ inch from the forward position A, microswitch M9 is depressed. Microswitch M9 activates a solenoid operated air valve S1 which sends air to pulse relay 194.

The pulse relay 194 allows only a short pulse of air to pass through it. The air valve S10 is opened by this short pulse of air and thereby allows a short pulse of pressurized air to pass to air cylinder 172. The pulse of pressurized air sent to cylinder 172 reciprocates the cutting blade 176. Excess thread is thus cut from the leading edge of the cuff. The excess thread is moved by a small vacuum tube 186 to which a slight vacuum is applied via solenoid operated air valve S9 which is activated to its open position via relay R-3.

The sewing cycle continues and the support plate 74 continues in the direction of arrow 78 until it reaches it rearmost position B. When the support plate 74 reaches its rearmost position B, a seam has been stitched along one edge of the workpiece and microswitch M7 is depressed. Relay R1 is thereby pulled in. Relay R1 signals the solenoid operated air valve S2 to turn off. This releases the clamping bar 124 from its engagement with the endless belt 100 and also releases the motor clutch 188 from its engagement with shaft 120. The rearward travel of the support plate 74 is thereby stopped.

Relay R1 also signals the solenoid operated air valve S1 through the pulse relay 194 and the air valve S10 to pulse air to cylinder 172. Any excess thread is again cut by blade 176. The relay R1 also signals solenoid operated air valve S5 to send air to pulse relay 196. The pulse relay 196 and an air valve S11 operate in the same manner as relay 194 and valve S10 and send a pulse of air to cylinder 70. The piston rod 62, which is carried by cylinder 70, is reciprocated and the extension 68 is thereby released from a stop 55 on the indexing cam 42. The clamp 12 is thereby allowed to rotate in the direction of arrow 72. Since only a pulse of air is sent to cylinder 70, the piston rod 62 returns to its biased position after the pulse ends and the extension 68 return to engage the next stop 55. In this manner, the clamp 12 is rotated in a 90° increment.

As the clamp 12 rotates, microswitch M10 is engaged and moves to its dashed line position. The microswitch M10 thereby energizes a solenoid operated air valve S4. The energized valve S4 supplies pressurized air to cylinder 136, which moves the piston rod 138 and attached support plate 74 in the direction of arrow 76. Thus, the return travel of the support plate 74 from its rearward position B to its forward position A is begun. When the support plate 74 begins its return travel, it moves away from microswitch M7 and relay R1 drops out.

When the support plate 74 has returned to within approximately ½ inch of its full forward position A, microswitch M8 is activated. Microswitch M8 signals the valves S5 and S11 to activate the rotation of the clamp 12 another 90° increment, in the manner discussed above.

After the clamp 12 has completed a 180° rotation (i.e., after the first two 90° rotations), microswitch M4 is activated. The microswitch M4 will pull in relay R2, which is an auto-start relay. The sewing cycle will start again if the following microswitches are activated: M2; M3; M4 and M10. As mentioned above, these microswitches indicate that the clamp 12 is in its proper rotational position, that the support plate 74 is in its full forward position A and that the clamp 12 is closed.

The sewing machine is again running. The solenoid operated air valve S2 is again signaled to allow pressurized air to cylinder 134 and 188. Support plate 74 is thereby again driven from forward position A to rearward position B by the endless belt 100. A solenoid operated air valve S6 is activated by way of open relay R1 and closed relay R2.

Solenoid operated air valve S6 in its deactivated condition supplies air to one side of cylinder 184 such that the piston rod of cylinder 184 is retracted. When the valve S6 is activated, it supplies air to the other side of cylinder 184 which causes the piston rod to move outwardly from the cylinder 184. Since the valve S6 is not activated, the air supplied through the valve S6 to a cylinder 184 moves the stacker arm 160 from its retracted to its extended position. The solenoid operated air valve S8 is also activated at this time. Air is thereby supplied to cylinder 158 which raises the stacker fingers 150. Solenoid valve S8 is also activated by way of the open relay R1 and the closed relay R2.

When the support plate 74 and the clamp 12 again reach the rearward position B, a pair of spaced parallel seams will have been stitched along opposite edges of the workpiece. The microswitch M7 is again activated, the relay R1 is again pulled in and the rearward travel of support plate 74 is again stopped.

The solenoid operated air valves S1 and S10 are again activated and supply a pulse of air through pulse relay 194 to the cylinder 172. The thread is again cut by the cutting blade 176.

The microswitch M11 is activated and placed in its dashed line position. Solenoid valve S7 is thereby activated and supplies air to a cylinder 190 which causes the stacker jaws 162, 164 to close. Solenoid valve S9 is also turned off, thereby shutting off the vacuum for the waste thread.

At this time, relay R2 drops out because microswitch M4 opens and relays R3 and R4 drop out because microswitch M4 opens.

The clamp 12 is opened via a signal from the opened relay R4 and the microswitch M5 to the solenoid operated air valve S3. The relay R2 signals the valve S6 and the cylinder 184 to return the stacker arm 162 to its retracted position. When the stacker cylinder has returned far enough to its retracted position for the stacker cylinder to clear the clamp 12, the microswitch M11 is engaged and moved to its solid line position. The microswitch in this position signals the solenoid valves S5 and S11 to again rotate the clamp 12 another 90° increment, in the manner mentioned above.

When the clamp 12 has completed the 90° rotation, the microswitch M10 again activates the valve S4 which supplies air to the cylinder 136. Piston rod 138 and the support plate 74 attached thereto is again moved from the rearward position B to the forward position A. As discussed above, when the support plate 74 returns within one inch of its forwardmost position A, microswitch M8 is again activated causing the clamp 12 to again rotate 90°. Upon its complete return to the forward position A, the clamp 12 is again ready to receive another cuff.

The present invention may be embodied in other specific forms without departing from the spirit or essential attributes thereof and, accordingly, reference should be made to the appended claims, rather than to the foregoing specification as indicating the scope of the invention.

I claim:

1. Apparatus for sewing seams on a workpiece comprising:

a rotatable workpiece clamp for holding a workpiece;

said clamp being secured to a shaft for rotation therewith;

means for reciprocating said clamp between a forward and a rearward position;

means for stitching a seam to an edge of a workpiece while said means for reciprocating said clamp is moving said clamp from one of said forward and rearward directions;

drive means for rotating said shaft and said clamp in 90° increments after a seam has been stitched to an edge of a workpiece;

said drive means including a motor means drivingly coupled to said shaft, an indexing cam secured to said shaft, said indexing cam having a plurality of stop members, a pawl means for engaging said stop members and for allowing said indexing cam to rotate in 90° increments.

2. An apparatus in accordance with claim 1 wherein said shaft is hollow and said drive means for rotating said hollow shaft in 90° increments includes a sprocket fixedly attached to said shaft.

3. An apparatus in accordance with claim 2 wherein said motor means has a driven shaft connected through a clutch mechanism to a gear wheel and a chain connecting said gear wheel to said sprocket.

4. An apparatus in accordance with claim 3 wherein said indexing cam comprises a disc having a generally circular shape with four cut-out portions spaced in 90° increments along the periphery of said cam, said cut-out portions forming said stop members.

5. Apparatus for sewing seams on a workpiece comprising:

a rotatable workpiece clamp for holding a workpiece;

a support means for carrying said rotatable workpiece clamp;

means for reciprocating said clamp between a forward and a rearward position;

means for stitching a seam to an edge of a workpiece while said means for reciprocating said clamp is moving said clamp from one of said forward and rearward directions;

means for rotating said clamp after a seam has been stitched to an edge of a workpiece; and said reciprocating means including a first moving means having a motor means, an endless belt driven by said motor means, said endless belt passing a surface of said support means, and a clamping bar reciprocal between a position securing said belt to said support means and a position releasing said belt from said support means.

6. An apparatus in accordance with claim 23 wherein said first moving means moves said clamp from said forward to said rearward position, and a second moving means is provided for moving said clamp from said rearward to said forward position.

7. An apparatus in accordance with claim 6 wherein said second moving means includes a cylinder having a pneumatically driven piston rod extending therefrom, said piston rod being attached to said support means.

8. An apparatus in accordance with claim 2 wherein said workpiece clamp includes a pair of jaws, at least one of said jaws being movable between an open and closed position, a piston rod attached to said movable jaw for moving said jaw between said open and closed positions, an air cylinder carrying said piston rod for movement with respect to said air cylinder, a source of pressurized air communicating with said air cylinder, and said hollow shaft forming a portion of the communication between said source of pressurized air and said air cylinder.

9. Apparatus for sewing seams on a workpiece comprising:

a rotatable workpiece clamp for holding a workpiece;

means for reciprocating said clamp between a forward and a rearward position;

means for stitching a seam to an edge of a workpiece while said means for reciprocating said clamp is moving said clamp from one of said forward and rearward directions;

means for rotating said clamp after a seam has been stitched to an edge of a workpiece said workpiece clamp being carried by a rotatable hollow shaft; and said workpiece clamp including a pair of jaws, at least one of said jaws being movable between an open and closed position, a piston rod attached to said movable jaw for moving said jaw between said open and closed positions, an air cylinder carrying said piston rod for movement with respect to said air cylinder, a source of pressurized air communicating with said air cylinder, and said hollow shaft forming a portion of the communication between said source of pressurized air and said air cylinder.

10. An apparatus in accordance with claim 9 including a means for moving said workpiece from said clamp.

11. An apparatus in accordance with claim 9 including a means for cutting excess thread adjacent said stitching means.

12. Apparatus for sewing a pair of parallel spaced seams on a workpiece comprising:

a sewing machine;

a workpiece clamp for holding a workpiece having a jaw movable between an open and a closed position;

a pneumatically actuated piston rod connected to said movable jaw for moving said jaw between said open and closed positions;

a cylinder for carrying said rod;

a hollow rotatable shaft for carrying said clamp;

a source of pressurized air;

means for supplying said pressurized air to said cylinder;

said hollow rotatable shaft forming a portion of said last mentioned means;

a support means for carrying said shaft and said clamp;

an endless belt drive means adjacent a major face of said support means;

a means for driving said endless belt;

a means for intermittently securing said belt to said support to move said support and clamp from a first position past said sewing machine, to a second position whereby a seam is stitched along an edge of said workpiece;

means for rotating said shaft 90° at said second position;

means for moving said support and clamp from said second position to said first position;

said last mentioned means including a pneumatically actuated piston rod secured to said support means; and means for rotating said shaft 90° while said support and clamp are moving from said second position to said first position.

13. Apparatus in accordance with claim 12 including a means for removing said workpiece from said clamp after said support and clamp have reciprocated twice to said second position with a single workpiece.

14. Apparatus in accordance with claim 13 wherein said means for removing said workpiece includes a pair of jaws reciprocable between a position adjacent said second position and a workpiece stacking mechanism.

15. An apparatus for sewing a pair of parallel spaced seams on a workpiece comprising:

a sewing machine;

a workpiece clamp for holding a workpiece;

means for moving said clamp in a linear direction from an initial position past said sewing machine to stitch a seam along a first edge of said workpiece;

means for rotating said clamp 180° after said first edge is stitched;

means for returning said clamp along said linear direction to said initial position after a seam has been stitched along said first edge; and means for moving said clamp along said linear direction from said initial position past said sewing machine to stitch a seam along a second edge of said workpiece, said second edge being generally parallel to and spaced from said first edge.

16. Apparatus in accordance with claim 15 including a means for removing said workpiece from said clamp after a seam has been stitched along a second edge of said workpiece.

17. Apparatus in accordance with claim 15 wherein said clamp rotating means includes a hollow rotatable shaft and said workpiece clamp is attached to said shaft.

18. Apparatus in accordance with claim 17 wherein said clamp includes a movable jaw, a piston rod secured to said jaw to move said jaw, an air cylinder carrying said piston rod and a source of pressurized air communicating with said air cylinder, said hollow shaft forming a portion of the communication between said air cylinder and said source of pressurized air.

19. A workpiece clamp for holding workpieces while said workpieces are being sewn comprising:

a top plate, a bottom plate;

a hinge communicating said top plate to said bottom plate;

said plates being pivotable with respect to one another;

a movable piston rod for pivoting said plates with respect to one another, said rod having a free end attached to one of said plates;

a cylinder carrying said piston rod for movement with respect to said cylinder;

a hollow rotatable shaft;

the other plate being fixedly attached to said shaft;

means for rotating said shaft;

a source of pressurized air;

said pressurized air communicating with said cylinder by way of said hollow shaft for moving said piston rod.

20. Apparatus in accordance with claim 19 wherein said means for rotating said shaft includes means for rotating said shaft in 90° increments.

21. An apparatus in accordance with claim 5 wherein said clamping bar is biased to its releasing position.

22. An apparatus in accordance with claim 21 including a means for intermittently moving said clamping bar against said bias to its belt securing position.

23. Apparatus in accordance with claim 19 wherein said top plate is attached to the free end of said piston rod and said bottom plate is fixedly attached to said shaft.

24. Apparatus for sewing seams on a workpiece comprising:

a rotatable workpiece clamp for holding a workpiece;

means for reciprocating said clamp between a forward and a rearward position;

means for stitching a seam to an edge of a workpiece while said means for reciprocating said clamp is moving said clamp from one of said forward and rearward directions;

drive means for rotating said clamp in discrete increments after a seam has been stitched to an edge of a workpiece;

said drive means including a motor means drivingly coupled to said clamp, an indexing cam operatively connected to said clamp, said indexing cam having a plurality of stop members, a pawl means for engaging said stop members to stop the rotation of said indexing cam and for allowing said indexing cam to rotate only in said discrete increments.

* * * * *